United States Patent [19]

Bullard

[11] Patent Number: 5,062,413

[45] **Date of Patent: * Nov. 5, 1991**

[54] VACUUM TEETH CLEANING SYSTEM

[76] Inventor: Horace Bullard, 3333 Henry Hudson Pkwy., Riverdale, N.Y. 10463

[ * ] Notice: The portion of the term of this patent subsequent to Feb. 12, 2008 has been disclaimed.

[21] Appl. No.: 610,527

[22] Filed: Nov. 8, 1990

Related U.S. Application Data

[63] Continuation-in-part of Ser. No. 361,926, Jun. 6, 1989, Pat. No. 4,991,570.

[51] Int. Cl.[5] ..... A61H 9/00

[52] U.S. Cl. ..... 128/66

[58] Field of Search ..... 433/91, 92, 81, 224; 128/66, 62 A

[56] References Cited

U.S. PATENT DOCUMENTS

| | | | |
|---|---|---|---|
| 3,079,690 | 3/1963 | Lodige | 433/81 |
| 3,146,478 | 9/1964 | Rosenthal | 128/62 A |
| 3,211,149 | 10/1965 | Fono | 128/66 |
| 3,379,192 | 4/1968 | Warren, Jr. | 128/66 |
| 3,401,690 | 9/1968 | Martin | 128/66 |
| 3,452,746 | 7/1969 | Shanhouse | 128/66 |
| 3,731,675 | 5/1973 | Kelly | 128/62 A |
| 4,672,953 | 6/1987 | DiVito | 128/66 |

*Primary Examiner*—John J. Wilson

*Attorney, Agent, or Firm*—Eliot S. Gerber

[57] ABSTRACT

A system for cleaning teeth includes a vacuum motor and a liquid container, each being connected through suction and liquid lines, respectively, to a teeth cleaning head which forms an air tight chamber over two to five teeth. In one embodiment, a one-piece head member has a resilient oval lip which seals against the teeth, a cavity, and a rotatably mounted cleaning roller in the cavity, with the roller being roated by the force of the liquid as the liquid is pulled over the roller by the vacuum. In another embodiment two clamp members, each having a resilient lip, are urged against the front and back faces of adjoining teeth by a spring to form an air-tight chamber on the teeth.

11 Claims, 4 Drawing Sheets

VACUUM TEETH CLEANING SYSTEM

RELATED APPLICATION

This application is a continuation-in-part application partly based on Application Ser. No. 07/361,926 filed June 6, 1989, now U.S. Pat. No. 4,991,570.

BACKGROUND OF THE INVENTION

1. Field of the Invention

The present invention relates to dentistry and more particularly to a method and system for cleaning the teeth and gums.

2. Description of the Related Art

At the present time, generally a person will clean his or her teeth daily using a toothbrush having bristles, and a dentifrice. Another type of tooth cleaning system uses a cleaning head having small rotating brush tufts. In addition, dental floss and toothpicks are often used for cleaning between the teeth.

Although most people are reasonably conscientious concerning their dental (oral) hygiene and brush at least once a day, the incidence of gum disease, specifically periodontal disease, is very common. It is believed that periodontal disease is the major cause of dental problems, including teeth loss, in the adult population.

Periodontal disease (pyorrhea) is caused by bacteria and affects the tissues which house the roots of the teeth. The best prevention and treatment is to remove plaque and food residues, especially from between the teeth and in the region between the loose gum and the teeth, i.e., the gingival sulcus. Gingivitis is a form of periodontal disease in which the gum tissue (gingiva) is affected and periodontitus is the form in which the inflammatory region reaches deeper structure.

Although careful oral hygiene is so important in the prevention of periodontal disease, often the only daily hygiene is to brush the teeth using a toothbrush. However, brushing alone is not sufficient to remove food residue particles and plaque from between the teeth and under the loose gum flap, i.e., from the gingival sulcus.

In U.S. Pat. Nos. 3,566,869; 3,379,192 and 3,731,675 a mouthpiece fits over all the teeth of the user. Liquid dentifrice is continuously sprayed through fine holes onto all the teeth simultaneously and the liquid is sucked out by vacuum through a tube. In Patent 3,379,192 each user has his own fitted mouthpiece.

In U.S. Pat. No. 3,134,127 air and possibly a liquid, under pressure, are sprayed on the teeth and the liquid is removed by suction. The air and suction heads do not form an air-tight chamber on the teeth.

In U.S. Pat. No. 4,672,953 a teeth cleaning head has a vacuum port and a liquid outlet port. The head has a ring of bristles so that it does not form an air-tight chamber against the teeth.

OBJECTIVES AND FEATURES OF THE INVENTION

It is an objective of the present invention to provide a system for the cleaning of teeth in which the food particles will be more completely removed from the teeth, from between the teeth and from the gum region, compared to using a toothbrush.

It is a further objective of the present invention that such cleaning of the teeth is painless and may be about as fast as brushing with a toothbrush.

It is a further objective of the present invention that such cleaning of the teeth would remove sufficient food residue to help prevent and treat periodontal disease.

It is a further objective of the present invention that such cleaning of the teeth may be accomplished at home by the ordinary user without the requirement of special or extended training.

It is a further objective of the prevent invention that such cleaning of the teeth may be accomplished using the system of the present invention which is relatively simple to operate, relatively reasonable in cost and which is durable, safe, and reliable, and without an electric motor in the hand-held portion of the system.

It is a feature of the present invention to provide a system for the cleaning of teeth. The system includes a vacuum means to create a vacuum, such as a motor driven suction pump, and a source of liquid which is pulled by the vacuum across the teeth and through gaps between the teeth. The liquid source may be a replaceable or refillable container of water or mouthwash.

In one embodiment, a clamp means forms an air-tight chamber over two to five teeth. The clamp means comprises a first clamp member which fits on the front of the teeth and a second clamp member which fits on the back of the teeth. A vacuum (suction) line leads from the vacuum means to one clamp member and a liquid line leads from the liquid source to the other clamp member. A control means, such as a solenoid-operated air valve, is connected to the vacuum line in order to intermittently apply vacuum from the vacuum means to the clamp means and to thereby pull liquid from the liquid source through the gaps between teeth.

In another embodiment, the vacuum line and liquid line are connected to a single head member which attaches itself, by the vacuum on one side of two to five teeth. The head member has a soft rubber lip ring and may have a rotatably mounted roller. The roller is rotated by the movement over it of the water, and the rotating roller brushes the teeth.

SUMMARY OF THE INVENTION

In accordance with the present invention, there is provided a system and method to clean teeth which relies upon the vacuum force to pull a jet of water across or/and through the gaps between the teeth. The system includes a source of vacuum, preferably a small electrically driven vacuum pump, a tube to the vacuum source, a source of liquid, preferably a container of water or mouthwash, a switch operated solenoid valve which closes and opens a tube to the liquid container, and a special air-tight head member.

In one embodiment the head member is a clamp which is operated by the user so that one clamp member fits on one side of a few teeth (two to five teeth) and an opposite clamp member fits on the other side of those teeth. The clamp members form an air-tight chamber which is moved along the teeth. A flexible vacuum tube leads to one clamp member and a flexible liquid tube leads to the opposite clamp member. The vacuum pulls food residue from the gum area. When the switch is manually activated, or automatically and intermittently operated, the valve is opened and the vacuum pulls liquid from the container and through the gaps between the teeth, thereby removing food residue from the teeth.

In another embodiment, the head member is a one-piece member which is adapted to span one side (front side or back side) of two to five teeth. The device has a soft rubber ring (lip) which forms a seal, a water inlet port and a vacuum (suction) outlet port. The ports are preferably connected to a flexible tube having two channels, one for water and the other for suction, the head member, in two embodiments, has a rotatably mounted drum (roller) which is rotated by the movement of water from the inlet port to the outlet port and which brushes against the teeth to clean them.

BRIEF DESCRIPTION OF THE DRAWINGS

Other objectives and features of the present invention will be apparent from the following detailed description taken in conjunction with the accompanying drawings. In the drawings.

DETAILED DESCRIPTION

Figure 1:
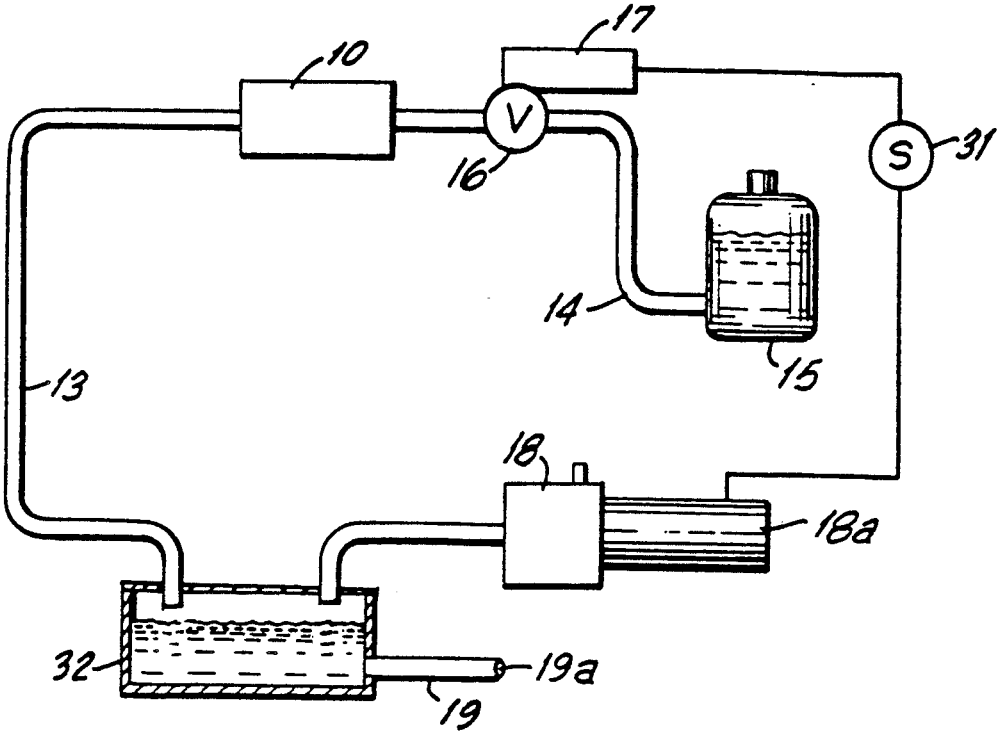
FIG. 1 is a block diagram of the system of the present invention.
Figure 2:
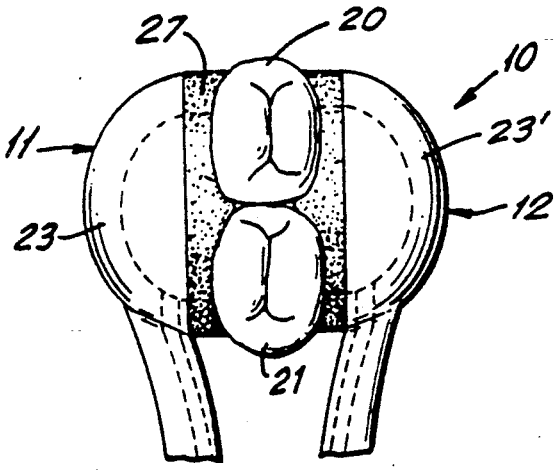
FIG. 2 is a top plan view of one embodiment of the two-piece clamp means (two-piece head member)

As shown in FIGS. 1 and 2, the system of the present invention in its first embodiment, is intended to apply a vacuum to a small air-tight chamber 10. The clamp means is moved along the teeth and the clamp members 11 and 12 are momentarily brought together over a pair of teeth. Alternatively, the clamp means may span three to five teeth. One clamp member 11 is on the front of the teeth and the opposite clamp member 12 is on the back of the teeth. The clamp members form an air-tight chamber.

A flexible tube, preferably a reinforced rubber tube 13 (hose) of one-eighth inch inner diameter, is connected to the clamp member 11. A second flexible rubber tube 14, of the same size, is connected to the water solution container 15 (source of liquid) which may be a mouthwash or plain water. The container 15 may be refillable or may be a container which is replaced when its, contents are exhausted. The tubes 13 and 14 are sufficiently thick or reinforced so that they do not collapse under the vacuum (suction) of the system. An electrically operated solenoid valve 16 is positioned in line 14 between the container 15 and the clamp member 12.

The electromechanical valve 16 is normally closed, i.e., the line 14 is normally closed. The valve is preferably operated intermittently by timer 17, for example, once per second. Alternatively, the valve 16 is operated to open line 17 by a switch which is operated by the user.

The tube 13 leads to a source of vacuum, preferably a suction (vacuum) pump 18. The vacuum applied is in the range of 15–30 inches of mercury (sea level). That is a relatively low vacuum and may be obtained using a suction pump operated by an electrical fractional horsepower motor 18*a*, for example, 1/16 H.P. A waste tube 19 (waste line) leads from the waste liquid container 32. The orifice 20 of tube 19 may be placed in a sink.

Alternatively, and not shown, a vacuum pump may be used which sucks both the liquid and air through the pump, thereby eliminating the liquid container 32.

Figure 3:
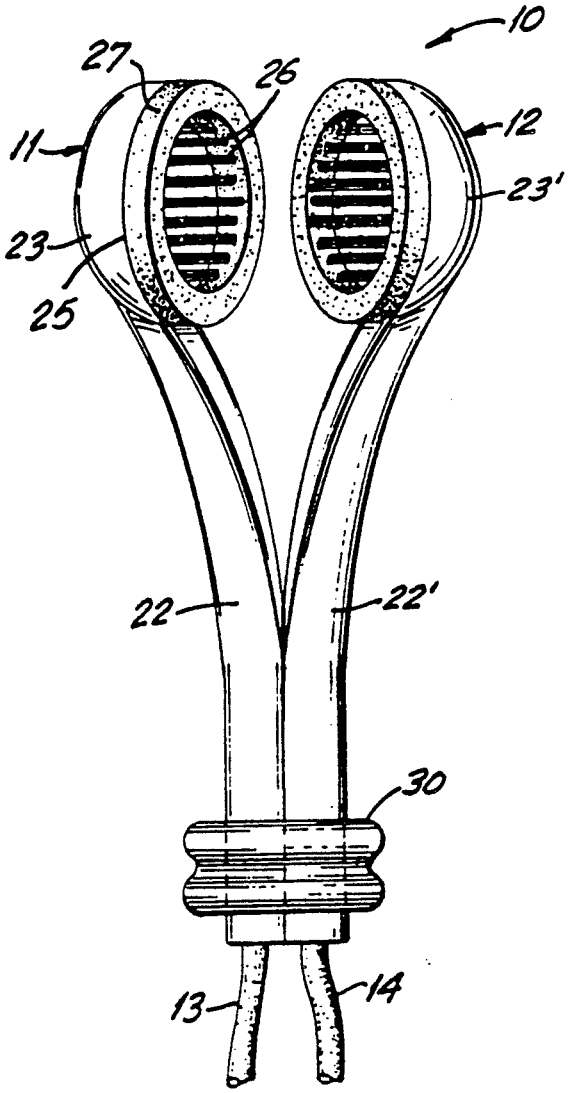
FIG. 3 is a perspective view of the clamp means of FIG. 2.

As shown in FIGS. 2 and 3, the clamp means 10 forms an air-tight chamber around two teeth 20 and 21. The clamp means 10, and the head means of the other embodiments, are not custom made or custom fitted members but may be used by anyone without being fitted or molded to their teeth. The clamp means 10 consists of first and second clamp members 11 and 12, respectively, which are constructed the same. The clamp member 11 has, as integral portions, a plastic resin handle portion 22 and a head portion 23. The head portion 23 is cup-shaped and has a cavity (depression) 24 and an edge 25. The wall of the cavity has protruding bristles 26 of the type used in toothbrushes. A flexible rubber oval-shaped ring 27 is secured to the edge 25 by an adhesive and forms a resilient seal with the teeth 20, 21.

A ring-like plastic member 30 is positioned over the handle portions 22,22' and urges the clamp members together, i.e., helps clamp members 11, 12 on the teeth.

In operation, the user pushes switch 31 which starts the pump 18 and timer 17. He then places the heads 23,23' over the teeth 20,21 to form an air-tight chamber on the teeth. The pump will pull liquid from container 15, through tube 14, head 23', the gaps in the teeth, head 23, tube 13 and out of waste tube 19.

The user will then continue to push the clamp means and move the clamp heads 23,23' over two other teeth and repeat the cleaning process.

Figure 5:
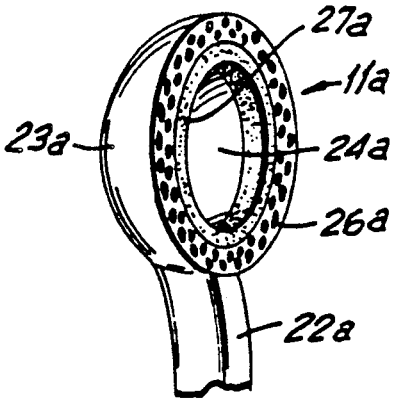
FIG. 5 is a perspective view of an alternative two-piece clamp head member.
Figure 4:
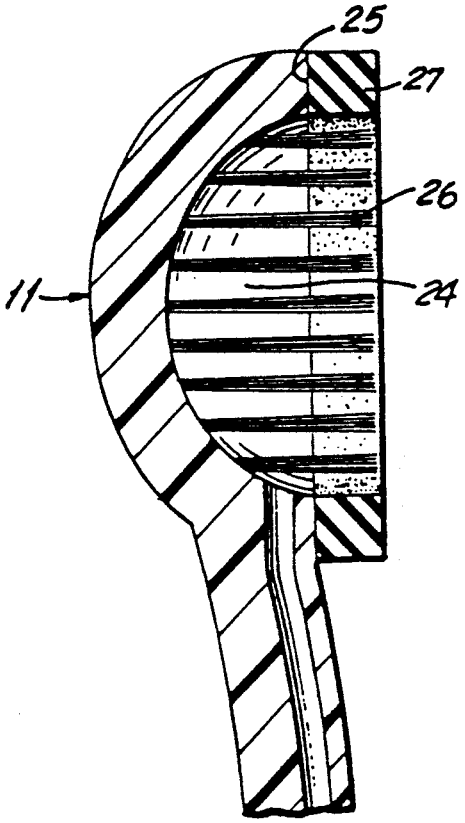
FIG. 4 is an enlarged cross-sectional view of a portion of the clamp means of FIG. 2.

An alternative clamp member 11*a* is shown in FIG. 5. In this embodiment the handle portion 22*a* is the same as handle portion 22 in the embodiment of FIGS. 3 and 4. However, the head portion 23*a* has the bristles 26*a* in a ring outside of the flexible soft rubber lip ring 27*a*. The ring 27*a* surrounds a cavity 24*a* through which the vacuum is applied.

Figure 6:
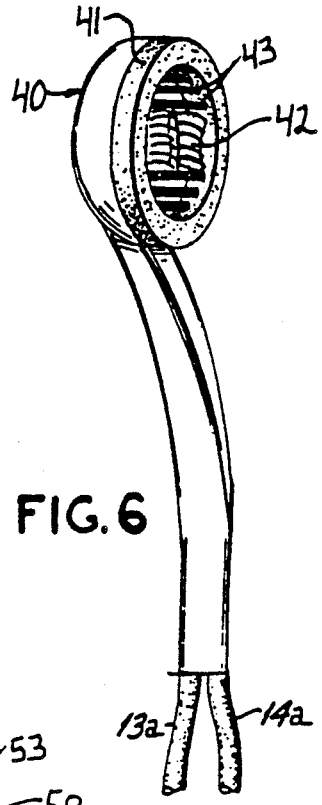
FIG. 6 is a perspective view of another embodiment utilizing a one-piece head member.
Figure 7:
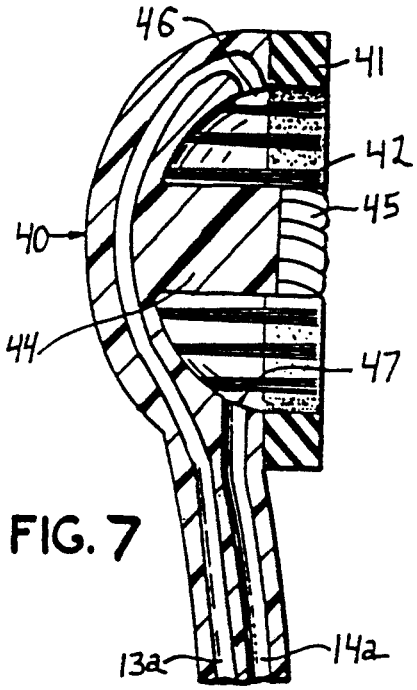
FIG. 7 is a side cross-sectional view of the head member of FIG. 6.

Another embodiment of the present invention is shown in FIGS. 6 and 7. In this embodiment the teeth cleaning member is a single head 40 which is first moved along the front and then the back of the teeth, or vice versa. The head 40 spans (covers) two to five teeth, preferably two teeth, the vacuum and liquid supply system is the same as shown in FIG. 1. However, both the vacuum tube 13*a* and water solution tube 14*a* lead to the same head 40. The tubes 13*a* and 14*a* may be arranged side-by-side, as in FIG. 3, or one inside the other, (not shown). For example the vacuum tube 13*a* may be an internal tube which is coaxial with a surrounding external water tube 14*a*.

The head 40 has an oval ring 41 of soft rubber material to form a seal with the teeth. The ring lip 41 forms the outer edge (lip) of a cavity 42. Bristle tufts 43 are positioned within cavity 42.

In addition, a raised flexible platform 44 has protruding fish-scale rubber fingers 45. The water inlet tube 14*a* terminates in a water outlet port 46, at the top of cavity 42, and the vacuum tube 13*a* terminates in vacuum suction port 47, at the bottom of the cavity 42.

Figure 8:
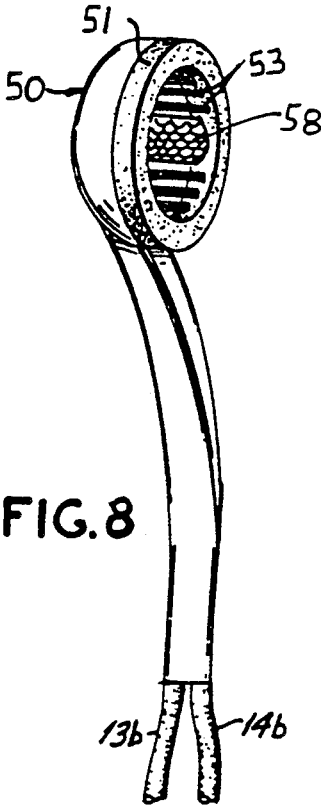
FIG. 8 is a perspective view of still another embodiment utilizing a one-piece head member.
Figure 9:
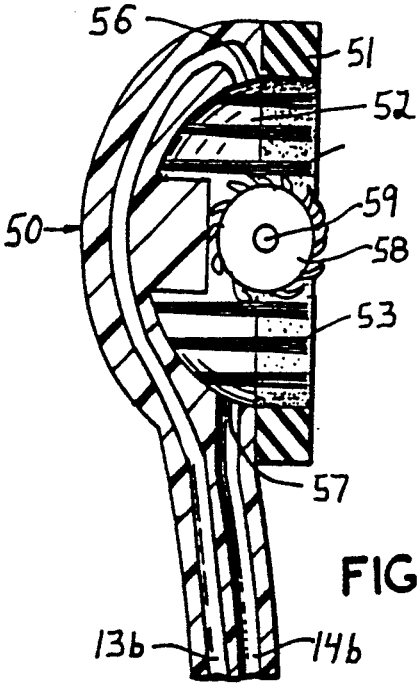
FIG. 9 is a side cross-sectional view of the head member of FIG. 8.

The next embodiment, shown in FIGS. 8 and 9, is similar to the previous embodiment in many respects. It uses the vacuum-water supply system of FIG. 1 and has a one-piece head 50 having an oval soft rubber ring (lip) 51, a cavity 52 with internal brush tufts 53, an inlet port 56 connected to water tube 14*b* and an outlet port 57 connected to vacuum tube 13*b*. The head 50 has a roller (drum) 58 mounted on shaft 59 which shaft 59 is rotatably mounted in the opposite side-walls of head 50. The roller 58 has a surface of raised fish scale rubber fingers. The roller rotates and cleans the teeth as the water from outlet port 56 is pulled by suction into inlet port 57. The moving water rotates (spins) the roller 59.

Figure 10:
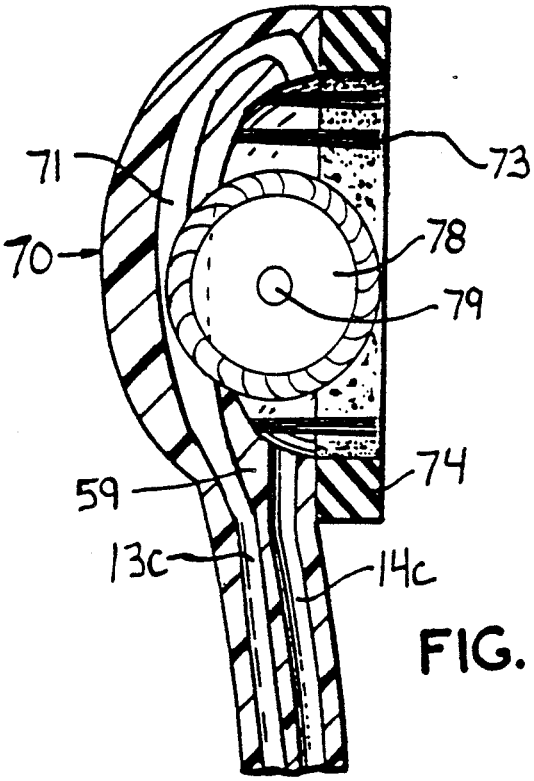
FIG. 10 is a side cross-sectional view of another embodiment utilizing a one-piece head member.

The embodiment of FIG. 10 is the same as that of FIGS. 8 and 9, except that the roller (drum) 78 has a larger diameter and extends through wall 59 so that it extends into the extension tube 71 of the water tube 14*c*. In this embodiment the roller 78 is rotated, in a manner similar to a water-wheel, by the flow of water through tube 71. Bristle tufts 73 are fixed above and below the roller 79 and their free ends are adapted to brush the teeth. The roller 78 has an external face of raised rubber fish-scale fingers and has a shaft 79 which is rotatably mounted in the opposite sidewalls of the head 70.

Figure 11:
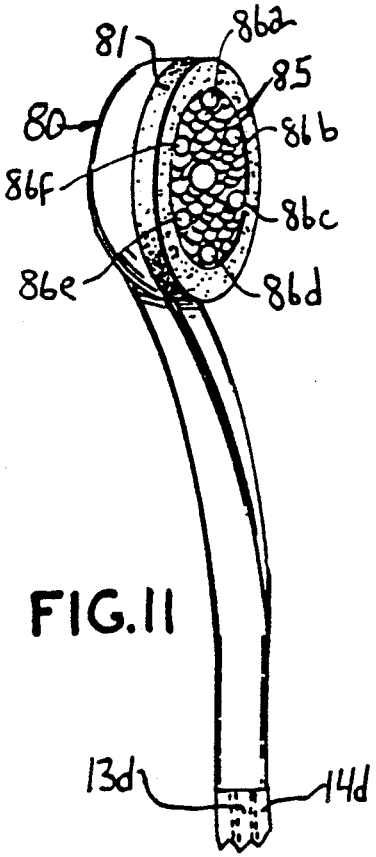
FIG. 11 is a perspective view of another embodiment.
Figure 12:
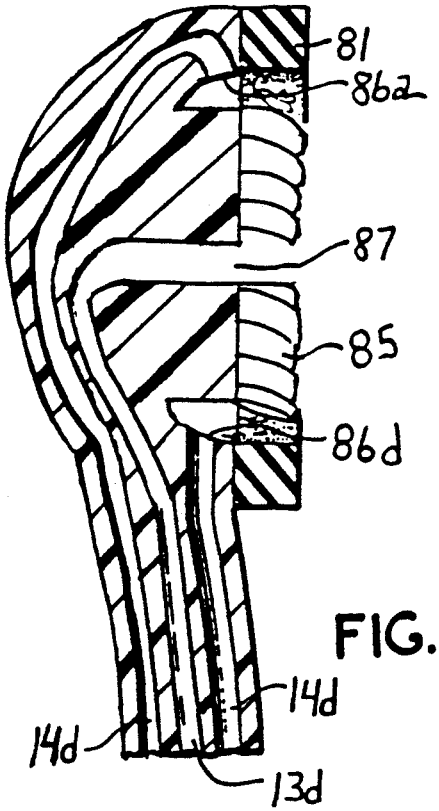
FIG. 12 is a side-cross sectional view of the embodiment of FIG. 11.

The next embodiment, shown in FIGS. 11 and 12, is similar to the embodiment of FIG. 6 and 7 in many respects. It uses the vacuum-water supply system of FIG. 1 and has a one-piece head 80 having an oval soft rubber ring (lip) 81, a cavity 82, a series of inlet ports 86*a*–86*f*, arranged in a ring and connected to water tube 14*d*, and a central outlet port 87 connected to vacuum tube 13*d*. The head 80 has raised fish-scale rubber fingers 85, which are fixed-in-place. In this embodiment the water tube 14*d* is exterior to an internal and coaxial vacuum tube 13*d*.

Modifications may be made in the present invention within the scope of the claims. For example, a major problem with older persons is their bad breath which is caused by decay material under their gums. That decay material may be removed by operation of a switch, preferably automatically operated by timer 17, which is connected to valve 16. Operation of valve 16 leaves the tube 13 open to suction pump 18 (10–30 seconds) after a period (10–30 seconds) of intermittent operation. That constant suction will pull the decay material from under the gums.

I claim:

1. A system for cleaning a set of teeth and gum adjacent thereto comprising:

(a) vacuum means to create a vacuum;

(b) a source of liquid to be pulled by the vacuum to clean the teeth;

(c) a non-custom formed head means to removably form an air-tight chamber over one side of at least two teeth and no more than five teeth; said head means comprising a single head member having a flexible circumferential ring lip means to form an air tight seal against the teeth and a cavity in said head means adapted to face the teeth; said head being a cup like member and including a plurality of bristles within said cavity, said bristles having free ends adapted to contact said teeth;

(d) a vacuum line leading from the vacuum means to the cavity;

(e) a liquid line leading from the liquid source to the cavity; and (f) control means connected to said vacuum line to intermittently apply vacuum from said vacuum means to said head means in order to pull liquid from said liquid means to within said chamber and thereby clean the teeth.

2. A system for cleaning a set of teeth as in claim 1 wherein said vacuum means includes an electrically powered motor driven vacuum pump.

3. A system for cleaning a set of teeth as in claim 1 wherein said source of liquid is a refillable container.

4. A system for cleaning a set of teeth and gum adjacent thereto comprising:

(a) vacuum means to create a vacuum;

(b) a source of liquid to be pulled by the vacuum to clean the teeth;

(c) a non-custom formed head means to removably form an air-tight chamber over one side of at least two teeth and no more then five teeth; said head means comprising a single head member having a flexible circumferential ring lip means to form an air-tight seal against the teeth and a cavity in said head means adapted to face the teeth;

(d) a roller within said cavity, and means to rotatably mount said roller so that it is rotated by the liquid pulled over the roller by the vacuum;

(e) a vacuum line leading from the vacuum means to the cavity;

(f) a liquid line leading from the liquid source to the cavity; and (g) control means connected to said vacuum line to intermittently apply vacuum from said vacuum means to said head means in order to pull liquid from said liquid source to within said chamber and thereby rotate the roller and clean the teeth.

5. A system for cleaning a set of teeth as in claim 4 wherein said vacuum means includes an electrically powered motor driven vacuum pump.

6. A system for cleaning a set of teeth as in claim 4 wherein said head member is a cup-like member and including a plurality of bristles within said cavity, said bristles having free ends adapted to contact said teeth.

7. A system for cleaning a set of teeth as in claim 4 wherein said source of liquid is a refillable container.

8. A system for cleaning a set of teeth as in claim 4 wherein said roller has an exterior face of flexible fish-scale fingers.

9. A system for cleaning a set of teeth and gum adjacent thereto comprising:

(a) vacuum means to create a vacuum;

(b) a source of liquid to be pulled by the vacuum through gaps between the teeth;

(c) a non-custom formed head means to removably form an air-tight chamber over both sides simultaneously of at least two teeth and no more than five teeth; said head means including a first clamp member to fit on the back of the teeth and a second clamp member to fit on the front of the teeth;

(d) each of said first and second clamp members being a cup-like member forming a cavity having a circumferential lip and a resilient seal material connected at each of said lips to form resilient ring lips adapted to seal said clamp means with said teeth to form an air tight chamber on said teeth;

(e) said head means including a spring means to normally urge said first and second clamp members toward each other;

(f) a vacuum line leading from the vacuum means to one clamp member;

(g) a liquid line leading from the liquid source to the other clamp member; and (h) control means connected to said vacuum line to intermittently apply vacuum from said vacuum means to one of said clamp members and to thereby pull liquid from said liquid source around the teeth within said chamber.

10. A system for cleaning a set of teeth as in claim 9 wherein said vacuum means includes an electrically powered motor driven vacuum pump.

11. A system for cleaning a set of teeth as in claim 9 wherein said source of liquid is a refillable container.

* * * * *